US008056473B2

(12) United States Patent
Frenken

(10) Patent No.: US 8,056,473 B2
(45) Date of Patent: Nov. 15, 2011

(54) METHOD FOR THE OPERATION OF A MOTOR-DRIVEN HAND-HELD PRESSING APPARATUS, AND HAND-HELD PRESSING APPARATUS

(75) Inventor: Egbert Frenken, Heinsberg (DE)

(73) Assignee: Gustav Klauke GmbH (DE)

( * ) Notice: Subject to any disclaimer, the term of this patent is extended or adjusted under 35 U.S.C. 154(b) by 74 days.

(21) Appl. No.: 12/599,936

(22) PCT Filed: May 16, 2008

(86) PCT No.: PCT/EP2008/056033

§ 371 (c)(1),
(2), (4) Date: Nov. 12, 2009

(87) PCT Pub. No.: WO2008/138987

PCT Pub. Date: Nov. 20, 2008

(65) Prior Publication Data

US 2010/0300308 A1 Dec. 2, 2010

(30) Foreign Application Priority Data

May 16, 2007 (DE) ..... 10 2007 023 068

(51) Int. Cl.
*B30B 13/00* (2006.01)
*B30B 15/26* (2006.01)

(52) U.S. Cl. ..... 100/35; 100/43; 72/453.16

(58) Field of Classification Search ..... 100/35, 100/43, 269.01, 270, 269.15; 72/453.15, 72/453.16, 453.06, 453.08, 453.02, 452.7, 72/452.4; 29/237, 270
See application file for complete search history.

(56) References Cited

U.S. PATENT DOCUMENTS

| | | | | |
|---|---|---|---|---|
| 5,111,681 | A * | 5/1992 | Yasui et al. | 72/453.03 |
| 5,727,417 | A | 3/1998 | Moffatt et al. | |
| 5,876,410 | A * | 3/1999 | Petillo | 606/142 |
| 6,206,663 | B1 | 3/2001 | Frenken | |
| 6,666,064 | B2 * | 12/2003 | LeFavour et al. | 72/453.15 |
| 6,957,560 | B2 * | 10/2005 | Lefavour et al. | 72/453.16 |
| 7,216,523 | B2 | 5/2007 | Frenken | |
| 2009/0133591 | A1 | 5/2009 | Frenken | |

FOREIGN PATENT DOCUMENTS

| | | |
|---|---|---|
| DE | 202 02 200 | 6/2003 |
| DE | 203 05 473 | 6/2003 |
| EP | 1 092 487 | 4/2001 |
| WO | 99/19947 | 4/1999 |

OTHER PUBLICATIONS

International Search Report completed on Sep. 2, 2008 with regard to PCT/EP2008/056033; Five (5) pages.

* cited by examiner

*Primary Examiner* — Jimmy T Nguyen
(74) *Attorney, Agent, or Firm* — Clark Hill PLC

(57) ABSTRACT

A hydraulic pressing unit includes a hydraulic pump, supply and hydraulic chambers, moving and stationary parts, a restoring spring, and a return valve provided within or attached to a housing. The moving part is displaced from a starting position into a pressing position as a result of filling the hydraulic chamber with a hydraulic medium from the supply chamber by using the hydraulic pump. The return valve is automatically displaced into an open position as a result of a hydraulic pressure corresponding to the pressing position, and the restoring spring moves the moving part. A piston acts on the flow of the hydraulic medium and lowers the pressure such that the return valve is displaced into the closed position.

16 Claims, 9 Drawing Sheets

1
4
11
12
13
14
10
VI
VI

10
µC

METHOD FOR THE OPERATION OF A MOTOR-DRIVEN HAND-HELD PRESSING APPARATUS, AND HAND-HELD PRESSING APPARATUS

This patent application is a the National Stage filing of IB application number PCT/EP2008/056033, filed May 16, 2008, published as WO 08/138,987 on Nov. 20, 2008. IB application number PCT/EP2008/056033 claims priority from German Patent Application No. 102007023068.2 dated May 16, 2007.

FIELD OF THE INVENTION

The invention relates in first instance to a method for operating a motor-actuated handheld pressing unit in which, in response to the actuation of a switch, one or more pressing jaws are moved from an opened starting position into a closed pressing position until a prescribed pressing force has been reached or a prescribed amount of time has elapsed, after which the pressing jaws are released automatically, for instance by the return of a pressing piston acting upon the pressing jaws, but it being possible for this release to be interrupted in an intermediate position before reaching the starting position, in order to begin a next pressing operation from such an intermediate position.

In addition, the invention also relates to a method for operating a motor-actuated handheld pressing unit in which, in response to the actuation of a switch, one or more pressing jaws are moved from a starting position into a closed pressing position until a prescribed pressing force has been reached or a prescribed amount of time has elapsed, after which the pressing jaws are released automatically, for instance by the return of a pressing piston, the pressing piston furthermore being actuated hydraulically by means of a hydraulic medium.

BACKGROUND OF THE INVENTION

Methods of this kind for operating a pressing unit are known. For example, reference may be made to WO 99/19947. The pressing unit known from this document is hydraulically driven. In addition, pressing units of this kind that are driven directly by an electric motor are also known. In this respect, reference may be made, for example, to DE 203 05 473 U1. Instead of two pressing jaws, it is also possible to provide just one pressing jaw, which is to be moved against a fixed counter-stop. See, for instance, U.S. Pat. No. 5,727,417.

It has also already been proposed, see for instance German patent application 10 2006 026 552, which is not a prior publication, that, when the pressing jaws are released in such a way that they can move or can be moved back into the opened or openable starting position (with regard to 'can be moved' it should be pointed out that, although pressing jaws of this kind are basically openable, they could also be biased by a spring into a closed position, see for instance DE 10 2005028 083 A1), an interruption of the movement into the starting position may be performed in such a way that a next pressing operation can be commenced right away from an intermediate position thereby chosen. Therefore, time is saved if a complete movement into the starting position is not required. This interruption must take place in each case in response to specific actuation.

Furthermore, measures intended to make it possible to check whether pressing has actually been carried out have already been proposed in various respects. EP 1 092 487 A2 has proposed in this respect a device on the pressing jaws which allows them to be reopened only after they have been completely pressed together. However, this measure for checking complete pressing is relatively complicated.

SUMMARY OF THE INVENTION

On the basis of the prior art described above, in terms of the method, it is an object of the present invention on the one hand to be able to achieve the advantage of the intermediate position without intervention being necessary in each case in similar operations, and on the other hand to provide a method for operating a pressing unit which makes it possible to reliably achieve and maintain a specific pressing pressure in the simplest possible manner. In addition, in terms of the device, it is an object of the invention to provide an advantageous pressing unit.

A solution that achieves the object in terms of the method, at least with regard to one aspect, because it is provided that, in relation to an interruption, a measurement of travel and/or time and/or pressure determined during the pressing operation and associated with the intermediate position is detected and stored in order to be able to automatically interrupt, during subsequent pressing operations, the releasing action in the intermediate position in question, as a result of said measurement.

The first important point here is that, even in such a case, the release is not necessarily interrupted at the said intermediate position. It can, however, be interrupted. In other words, this makes the pressing unit capable of being variably used, as it were so that it (only) interrupts the release at the intermediate position when suitable actuation occurs. Similar operations can thus always be carried out from the same intermediate position. It may suitably be provided in operating terms, as also further explained below, that no specific actuation is required with regard to the actual interruption at the intermediate position, but if no further interruption is intended to take place at the intermediate position, this can be achieved by a specific actuation of the unit—more preferably: a single actuation. Conversely, it is equally possible that an interruption of the pressing jaw release only takes place at the desired intermediate position in response to specific operation of the unit, i.e. in particular in response to specific actuation of a switch, but otherwise does not take place.

It is further preferred in this connection that the storage of the said measurement or measured value always takes place, for every pressing operation, irrespective of whether or not the interruption is applied using this measurement.

Specifically, there are many possible ways in which this can actually be carried out. Firstly, it is advantageous that first workpiece contact is determined and a travel or time marker associated with this first workpiece contact is recorded. The workpiece contact may in principle be detected by a pressure sensor, for example disposed in a pressing jaw. The workpiece contact may, as a further example, take place by evaluation of the motor current. As soon as there is a significant increase in the motor current, this can be interpreted as workpiece contact.

In the same way, the pressure of the hydraulic medium may also be detected by means of a pressure sensor. Since the pressure of the hydraulic medium has an approximately linear pressure rise and pressure fall during the forward and return travel of the piston, on account of the friction of the piston in the cylinder and the force of the return spring, the actual position of the piston in the cylinder can also be determined from this with a certain tolerance. To this extent, a pressure value—measured over time—can be converted into a travel value and to this extent, as also explained below with reference to a travel value, converted with regard to the position of the piston, and consequently ultimately of the pressing jaws, or be used as an analog value for this.

The associated position of an actuating element acting upon the pressing jaws can consequently be recorded and subsequently, after pressing has taken place, the interruption for achieving the intermediate position can then take place, in accordance with this measurement, in the course of the release of the pressing jaws. The point chosen will suitably not be exactly the same point at which the unit has detected workpiece contact, in the case of the example cited through the rise in the motor current, but instead a certain allowance will be added to this measurement of travel, pressure or time thus determined, in order to be certain to achieve an intermediate position in which the next pressing operation can commence again without hindrance. Without hindrance means here in particular that the pressing jaws are open slightly further than would actually be required.

The allowance that is added to the measurement of travel, pressure or time may lie between 0 and 50% of the measurement, this range also including all intermediate values, to be precise in particular in 1/10% increments. The allowance may therefore lie between 0 and 40.9% and 0 and 40.8%, etc, or else between 0.1 and 50%, 0.2 and 50%, 0.3 and 50% and, on the other hand, also between 0.1 and 40.9%, 0.2 and 40.9%, 0.2 and 40.8%, etc. Of these values, 0 to 10% is particularly preferred, once again including intermediate values as specified.

Practical applications concern, for example, the pressing together of fittings and pipes by means of an over-engaging pressing sleeve. With the aim of achieving a tight connection between two abutting pipes, if a large number of pressing operations subsequently take place on the same length of pipe or on lengths of pipe of the same nominal width, each of which operations does not require the pressing jaws to be moved into the starting position but for which an intermediate position in which the interruption of the release takes place is advantageous, very efficient work can be performed with a configuration as described here. A further application is the pressing (crimping) of a cable lug.

A further possible way of determining the intermediate position is also that of measuring the time from workpiece contact to completion of the pressing operation and interrupting the release of the pressing jaws after the elapse of a travel distance since the completion of the pressing operation that corresponds to the time measured. The interruption therefore takes place (only) time-dependently, the travel being readily determinable (for example by way of a factor applied to the time measured) on account of the given relationships (during the return there is virtually no disturbance to take into consideration, so that a specific time since the beginning of the return corresponds quite precisely to a specific piston travel).

The end of the pressing operation itself is suitably detected in a conventional manner, for instance on the basis of the pressure drop and/or in response to the opening of a return or overload valve, if appropriate also merely on the basis of the elapse of a specific time period, for instance measured since the beginning of the pressing cycle.

To this extent, it is also advantageous that the intermediate position can be stored and, in dependence on specific actuation or non-actuation of the pressing unit, the return is carried out for following pressing operations in each case only up to the intermediate position. This can be achieved by, for instance, the interruption at the intermediate position taking place—repeatedly—only as long as a starting button of the unit remains continuously depressed. As soon as the depressing of the start button no longer occurs, the unit then moves back into the original starting position. In spite of the depressed start button, switching-off of the motor, whether it is the hydraulic motor or the electric motor, can then nevertheless take place after completion of the pressing operation. The—still—depressed start button then ensures that the interruption of the return or the release of the pressing jaws takes place at the associated intermediate position, for instance by brief automatic actuation of the hydraulic pump in the case of the interruption of the return, according to the initially cited German patent application 10 2006 026 552. To start a new pressing cycle, it may then be required first to release the start button and then depress it again. In this way, in principle, a time of any desired length may elapse before the next pressing cycle is triggered by depressing the start button. To achieve the desired sequence, i.e. the interruption of the return at the desired position, all that is necessary then is to keep the button depressed until the desired interruption of the return. For example, here, too, the switching may be provided in such a way that the start button need not remain depressed until the actual interruption of the return but only over a longer time period than usual when triggering the pressing operation.

The interruption of the return at a desired point accordingly has the consequence that the pressing jaws or a movable pressing jaw with a fixed counter-stop only have at most such an opening dimension that is associated with this interruption when the interruption has taken place. This may mean, for instance, that, although displacement on the same length of pipe to a further pressing point is possible, complete removal of the unit from the pipe in question is not possible. To this extent, there is also a safety aspect, for example that the unit cannot fall off.

As a further alternative, it may also be provided that the measurement of travel and/or pressure and/or time is recorded as a result of a freely selected interruption. Therefore, as soon as an interruption takes place, for instance by brief touching of the button for triggering a pressing operation (see the aforementioned German patent application 10 2006 026 552), this associated measurement of travel and/or pressure and/or time (measurement of time for instance concerning the time that has elapsed since completion of the pressing operation) can be recorded and the interruption then automatically takes place at the same point during a next pressing operation. All that is then necessary is for the next pressing operation to be initiated, for instance by brief depressing of the start button, and then it automatically ends again at the chosen intermediate position, without any other actuation being required. If it is desired to return to the starting position again, this can take place for instance by depressing the start button for a long time or twice or the like; depending on which "detection" is preset or preprogrammed on the unit.

As a further alternative, the measurement of travel and/or pressure and/or time may also be recorded as a result of a change in the actuating cycle. This may take place, for instance, by providing that, up to the desired intermediate position, the forward movement of the actuating part for the pressing jaws beginning from the starting position then takes place (on the "outbound path" to a—first—pressing operation) by repeated brief actuation of a start button of the unit. As soon as the desired intermediate position is reached, the start button can then remain continuously depressed until the pressing operation has been completed. Then, the start button can be released and the release of the pressing jaws then automatically takes place only up to the intermediate position. In response to renewed actuation of the start button, whether keeping it constantly depressed or only brief actuation, the next pressing cycle then proceeds correspondingly in the same manner.

With regard to the desired maintenance of a prescribed pressing force, the invention proposes that the reaching of the prescribed pressing force is checked by means of a pressure sensor detecting the pressure of the hydraulic medium. The pressure sensor already referred to above may therefore also be used in this connection. The checking may be specifically carried out for example by a comparison between a prescribed minimum pressure value and a pressure value actually achieved. If, for example, the pressing should have reached at least a pressure value of 500 bar, this value may be prescribed as the minimum pressure value and compared with a pressure value achieved, for example 600 bar or 650 bar. As long as the difference between the pressure value actually achieved and the prescribed pressure value is positive, such pressing may be considered to be in order.

In a further respect, such a pressure sensor may also be used for the purpose of checking a desired automatic opening of the return valve by means of the pressure detection. The actual setting and function of the automatically-opening return valve can be checked by means of stored corresponding curves, which correspond to a complete pressing operation, with regard to the sharp drop in pressure that occurs during the automatic opening of the return valve. In particular, corresponding storage of values can be used during servicing work for setting the return valve, without any actual application of pressure having to be actually carried out.

In special cases, for instance in expanding operations for pipes, it is desired that a certain pressure value, an expanding pressure value, is maintained over some time without opening of the return valve taking place. To this extent, the provision of the pressure transducer can be used for stopping the moving part to achieve maintenance of pressure by means of prescribing a threshold pressure value that lies below a maximum pressure value to be achieved for the ending of a pressing cycle. In the case of the automatically-opening return valve, the maximum pressure value would to this extent correspond to the triggering pressure set with respect to the return valve. The threshold pressure value is in this case accordingly selected below the triggering pressure of the return valve. When the threshold pressure value is reached, switching-off of the motor which actuates the hydraulic medium pump then suitably takes place. The pressure is therefore maintained. The pumping operation can then be continued by prescribed or manually selected further actuation of the triggering switch. The prescribed actuation of the triggering switch can accordingly proceed automatically and take place after the elapse of a time period, which may be freely selectable, from the switching-off of the motor after the threshold pressure value is reached. Here it may, however, also at the same time be provided in a variant that, when further actuation under pressure is detected, that is to say at the threshold pressure value that may be prescribed, the opening of the return valve takes place at the same time as the further actuation, since the pressure application required for this working purpose has been reached and a further rise in pressure to the automatic opening of the return valve is no longer required (in the normal cycle).

With regard to the configuration of a pressing unit itself, the invention proposes a motor-operated handheld pressing unit, with a fixed part and a moving part, the moving part being moved in relation to the fixed part by a hydraulic piston that runs in a hydraulic cylinder and is movable back into a starting position by means of a return spring.

With regard to handheld pressing units of this kind, reference is also made to the literature references already cited at the beginning.

For advantageously forming such units, the invention proposes that a current sensor for detecting the motor current and/or a pressure sensor for detecting the hydraulic medium pressure in the hydraulic cylinder are provided, the relevant hydraulic medium pressure being used for evaluation by means of the pressure and/or current measurement, and/or a measurement of travel derived from this pressure being used for further determination.

In a preferred embodiment, it is provided that a determination of the piston position is carried out by means of the pressure sensor.

In a further preferred embodiment, it is provided that a—suitably preprogrammed—microcontroller is provided for the evaluation of the signals supplied by the pressure sensor and/or a current sensor and/or a timer and/or a travel sensor. It is also preferred, in particular, that only a pressure sensor, i.e. no travel sensor and no current sensor, but however a timer, are provided, or only a current sensor, that is to say no travel sensor and no pressure sensor, but however a timer (if appropriate) are provided. On the other hand, in particular, the pressure sensor may be provided in combination with the current sensor, and with a timer.

In a further preferred embodiment it is provided that an electrical line transmitting the signal of the pressure sensor to a microcontroller is branched and that one branch line is connected unfiltered to an ADC channel of the microcontroller, while the other branch line is provided with a boosting unit and/or a lowpass filter.

It is further preferred that a pressure prevailing in the hydraulic medium when a pressing operation is switched on is measured and compared with a desired value. In this way it can firstly be established whether the action concerned is a switching-on of the pressing unit in a normal starting position, in which merely the biasing pressure caused for example by the return spring (with a certain loading) is applied, or whether it is a renewed switching-on of the pressing unit after switching-off and pressure, for instance if in the course of an expanding operation a specific pressing pressure is to be continuously applied to the workpiece over a certain time.

In a further preferred configuration, it may then be provided that, in dependence on the pressure of the hydraulic medium determined during the switching-on, an opening of the return valve is carried out in association with this switching-on. This procedure is, in particular, significant once again with respect to the expanding process already given by way of example. If it is established on the basis of the comparison with a desired value that the action concerned is a renewed switching-on under pressure, then, with this renewed switching-on, the desired or prescribed holding time under pressure has likewise also elapsed in the course of the operation—for example an expanding operation. Consequently, with this renewed switching-on, at the same time the opening of the return valve can then be carried out in combination.

It is generally preferred that the pressure is measured at regular time intervals after the switching-on of the unit, for example in time intervals of less than one second, further preferred in time intervals that lie between 1 and 20 milliseconds.

DESCRIPTION OF THE DRAWINGS

The invention is further explained below on the basis of the accompanying drawing, which however merely represents exemplary embodiments, and in which:

FIG. 9 shows a representation according to FIG. 8, plotted against time;

DETAILED DESCRIPTION OF THE ILLUSTRATED EMBODIMENT

Figure 1:
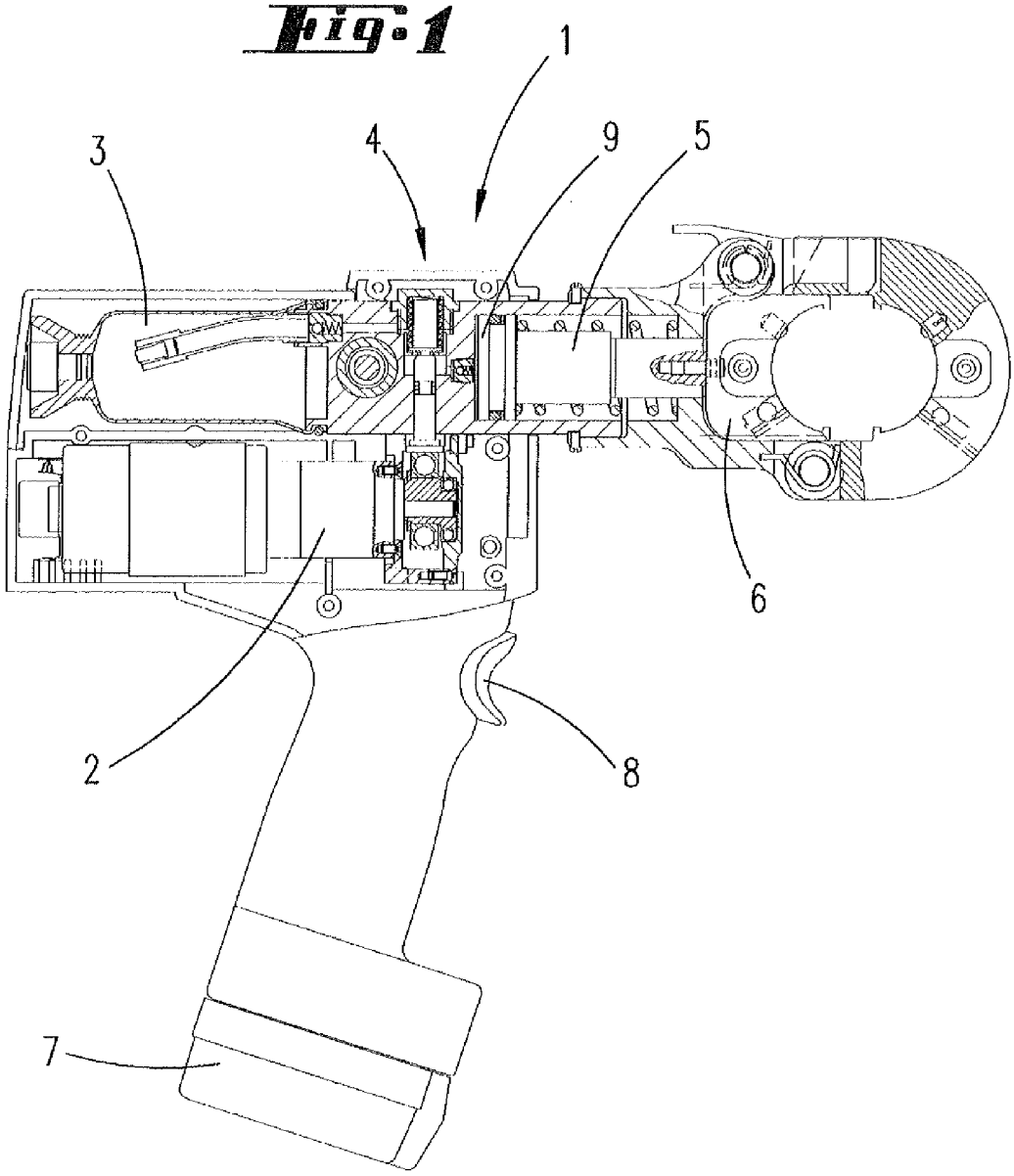
FIG. 1 shows a partially sectioned representation of a first pressing unit with a pressing jaw in the starting position.
Figure 2:
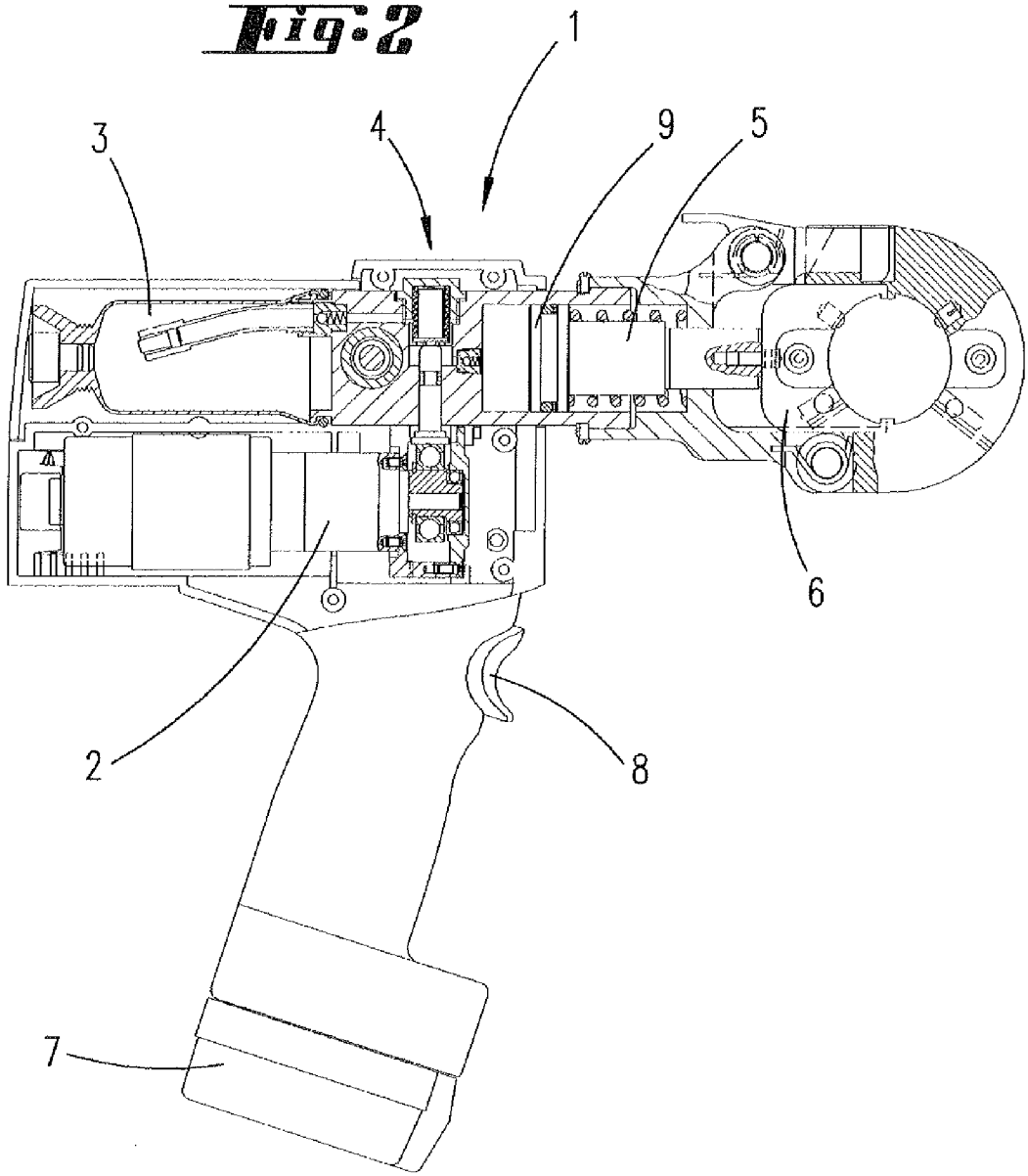
FIG. 2 shows a representation according to FIG. 1, with the pressing jaw in the pressing position.
Figure 3:
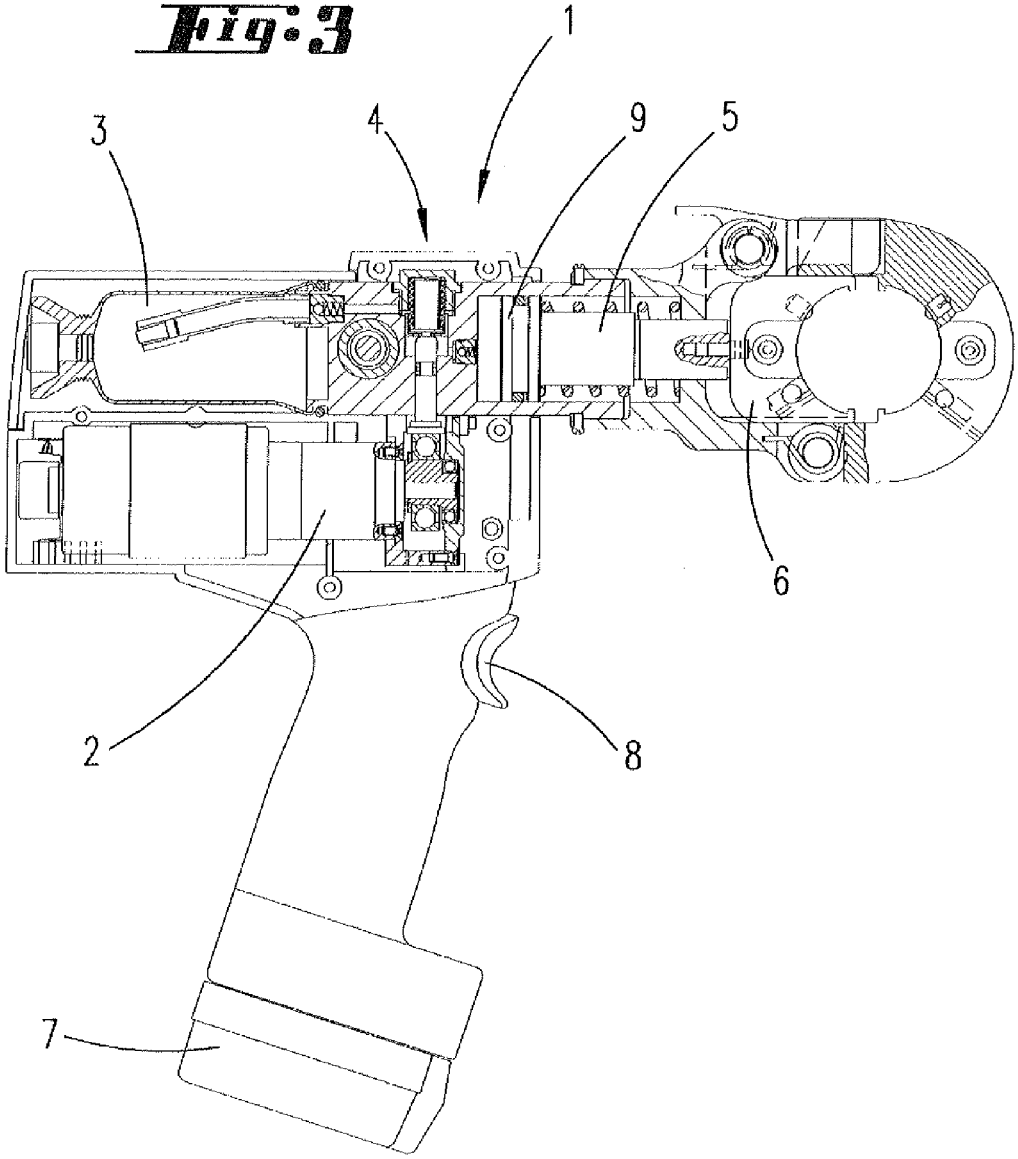
FIG. 3 shows a representation according to FIG. 1 or FIG. 2 with the pressing jaw in the intermediate position.

Presented and described, in first instance with reference to FIGS. 1 to 3, is a hydraulic pressing unit 1 with an electric motor 2, a reservoir 3 for hydraulic medium, a pump assembly 4 and a pressing piston 5, which is connected directly to a pressing jaw 6.

In the case of the exemplary embodiment, the electric motor 2 is operated by means of electrical energy stored in a rechargeable battery 7, which is not specifically represented.

The beginning of a pressing cycle can be triggered by means of a start switch 8.

In the case of the exemplary embodiment represented, in response to the actuation of the switch 8, the electric motor 2 will begin to run and hydraulic medium will be correspondingly pumped by means of the pump 4 out of the hydraulic medium reservoir 3 into the hydraulic cylinder 9, whereupon the hydraulic piston 5 moves, together with the pressing jaw 6, from the starting position, represented in FIG. 1, into the pressing position, represented in FIG. 2.

Figure 10:
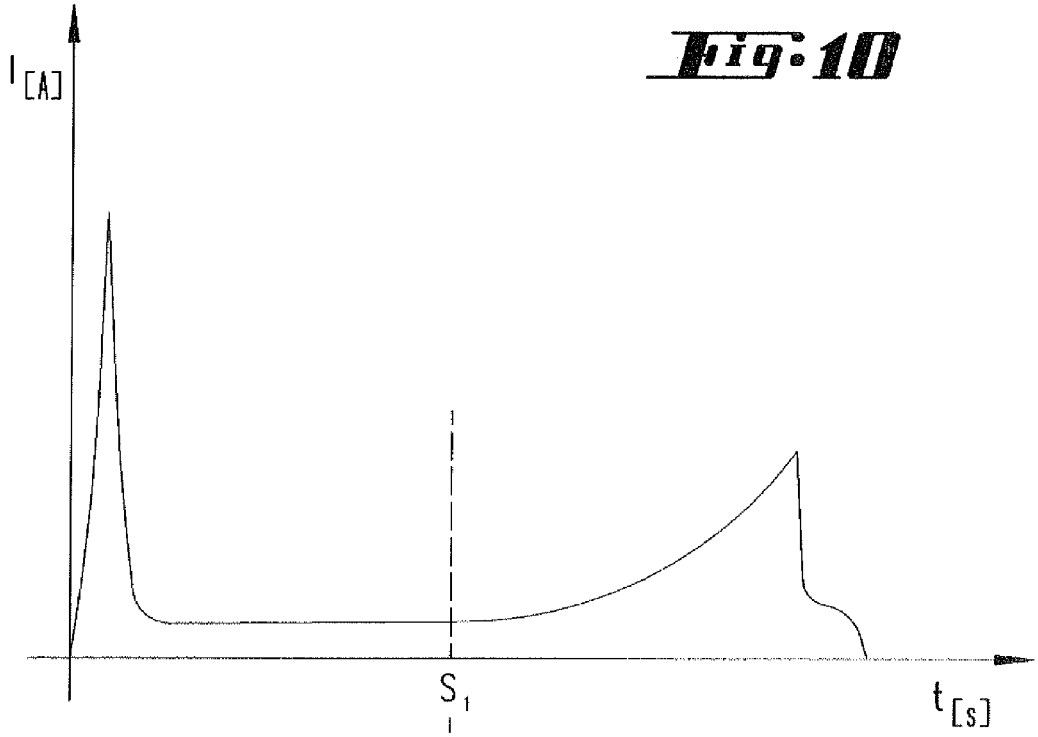
FIG. 10 shows a first schematic representation of the motor current during pressing, plotted against the travel.
Figure 11:
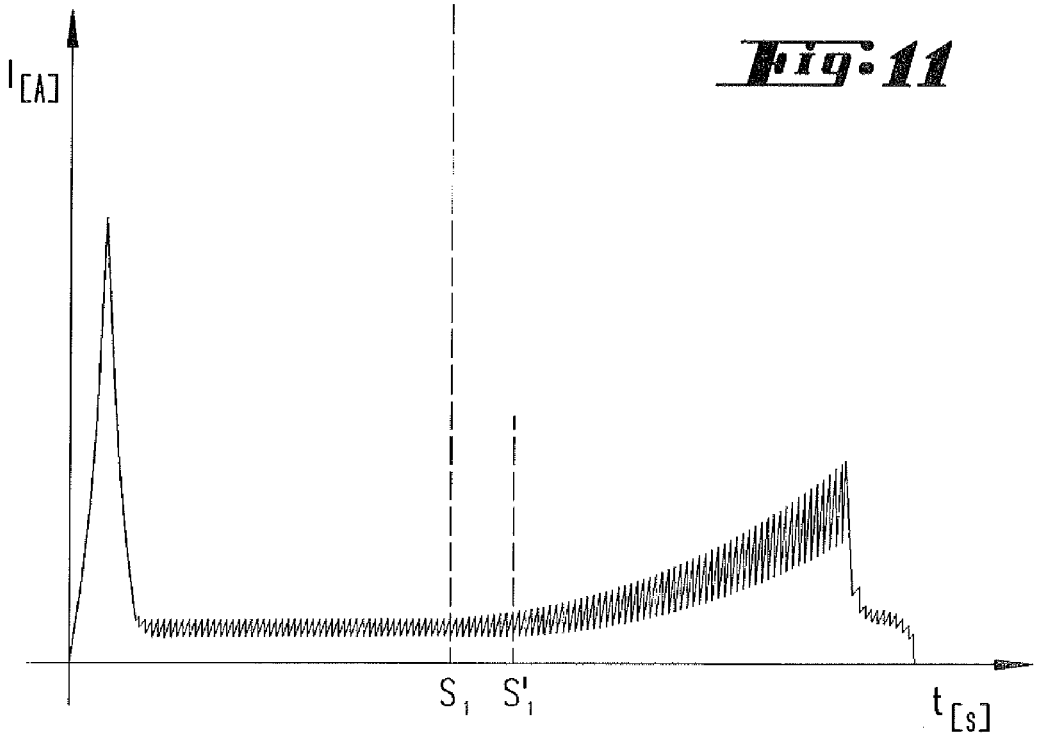
FIG. 11 shows a representation according to FIG. 10, but in the case of a different construction of the pump.

In a further embodiment, a current sensor may be provided in respect of the current drawn by the electric motor 2, the sensor detecting a current profile over the travel of the hydraulic piston 5, as quantitatively represented in the FIGS. 10 and 11.

FIG. 10 relates here to a hydraulic pump of a conventional type and the qualitatively quite fundamental profile of the current curve. FIG. 11 relates to the profile of the current curve in the case of a two-stage hydraulic pump, here again however not exactly reproduced but represented qualitatively, specifically for such a two-stage hydraulic pump as is known from EP 0 927 305 B1.

In both cases, there is initially a very high current pulse to be seen, associated with the switching-on of the unit. In practice, the value for this is, for example, around 80 amperes. This current value decreases very rapidly as the electric motor runs up to speed, to a value that lies only a little above the idling current of the motor. At the beginning of workpiece contact, there is in principle a rise in the motor current. If a certain threshold value is exceeded, this being associated in FIGS. 10 and 11 with the travel Sl (this is likewise also a measurement of time, although it will be appreciated that the travel can only be plotted up until the closing of the pressing jaws), storage of this travel value takes place for instance in a memory chip which is accommodated in the unit and may have for this purpose a volatile memory. It can be seen that the current curve then rises up to a maximum value. This corresponds to the completion of the pressing operation and the triggering of the return valve, after which the hydraulic pressure correspondingly falls abruptly and the hydraulic pump is also automatically switched off.

With regard to the representation in FIG. 11, there is to this extent a characteristic difference when the current curve rises (not yet significantly) after the travel S1. In practice, it may not only remain the same but even initially fall. This is attributable to the fact that at this point, a switch-over of the two-stage reciprocating pump from the first stage to the second stage takes place. Since the second stage operates, as it were, with a much higher transmission ratio, initially the motor current that is required is the same or in some cases even lower.

But also in the case of a qualitative profile of the motor current corresponding to FIG. 11, a significant steep rise in the motor current the takes place after a certain further travel or a certain further time period up to the completion of the pressing operation.

On the basis of the value stored, an interruption of the return of the hydraulic piston 5 after completion of pressing may then take place at this associated travel marker S1. In the case of the qualitative profile of the motor current according to FIG. 11, a computational allowance may then also be made, if for instance in the case of actual units, it is deemed appropriate, depending perhaps also on the power of the unit, to define contact only as from the travel or time S'1, that is from the beginning of the actual rise in the motor current.

Interruption may, for example, take place as specifically explained in the aforementioned patent application 10 2006 026 552. The relationship between the motor current and the travel, for instance according to FIG. 10, may be stored in a nonvolatile memory during the production of the unit.

It is also clear from the above that it is possible to work in principle in the same manner with corresponding measurements of time.

Once a certain threshold value has been exceeded with regard to the rise in the motor current, the threshold value being associated with the value of the travel S1 indicated in FIG. 10, storage of this associated travel value takes place, for instance in a memory chip which is accommodated in the unit and may have for this purpose a volatile memory. The travel value may, for example, be obtained by converting the motor current detected over time, since there is a sufficiently accurate (at least with averaging: linear) relationship between the travel of the piston and the motor current (only) required, at least up to first workpiece contact. Interruption of the return of the hydraulic piston 5 after completion of pressing then takes place at this associated travel marker S1. Interruption may take place, for example, as specifically explained in the aforementioned patent application 10 2006 026 552. The relationship between the motor current and the travel, for instance according to FIG. 5, may be stored in a nonvolatile memory during the production of the unit.

As an alternative or in addition, the relative position between the hydraulic cylinder and the hydraulic piston, in the case of a piston unit, may, for example, be detected for a travel measurement, for instance by means of one or more (two to four) or a multiplicity of (five or more) proximity switches which are provided in the hydraulic cylinder over the length thereof and can each detect the position of the hydraulic piston.

The completion of the pressing operation may be detected, for example, by a sharp drop in the motor current taking place along with the opening of a return valve, which drop is then used for detecting the end of the pressing operation.

Since the time which elapses from workpiece contact up to the completion of the pressing operation is not the same for every pressing, but rather may depend on individual pressing conditions, such as in particular the materials pressed, the time which elapses from first workpiece contact, for instance detected in the manner explained above, up to the completion of the pressing operation, may, in addition or as an alternative, also be measured, and this measurement of time then used correspondingly to trigger the interruption after completion of the pressing operation and the elapse of this amount of time, so that—in the exemplary case—the hydraulic piston assumes the desired intermediate position.

Since a greater travel is generally covered in the same amount of time in the case of unhindered return than in the case of the advancement under pressing conditions, there is at the same time also a generally desired "excess", in order to be certain of having achieved the interruption or the release of the pressing jaws before the position (the release position of the pressing jaws) that is required as a minimum to allow the next pressing to be carried out.

With regard to the time measurement, a timer may be provided in the unit, for instance also in the form of a microchip. In the case where a time period is to be detected, this timer will begin to count as from a specific triggering time, and the time period that is thus determined is recorded, at a specific end time, and stored, for example, in the volatile memory.

Specifically for instance whenever the time period from first workpiece contact (for example obtained by detecting the characteristic increase in the motor current) up until the completion of the pressing operation (for example obtained by detecting the drop in the motor current after the return valve has opened) is measured, and this time period is then prescribed for the return of the piston (in the case of a hydraulic unit), up until the interruption takes place at the intermediate position then determined for this, or in that the time from the automatic switching-off of the hydraulic motor after completion of the pressing operation (determination as described above) up until a (short) deliberate renewed switching-on for the interruption of the return is measured and after that, in the following cycle, this interruption takes place automatically—after the elapse of the time period thus measured and then stored. This automatic interruption can then take place, as also already described further above, in the case of each cycle as long as a specific mode of actuation is maintained, for instance keeping the start button depressed until the interruption has taken place.

It is generally not important for the return to take place always after reaching the same maximum pressure. If a travel sensor is used, the pressing times and pressing forces are not important. The build-up and release of the pressure may also be controlled by means of solenoid valves.

On the other hand, as also already described at the beginning, it is also possible in this connection to work with specific (mathematical) factors, whether they have the effect of lengthening or shortening the travel. These are generally obtained from empirical knowledge. They are, however, nevertheless prescribed at the factory when the unit is supplied.

Since a greater travel is generally covered in the same amount of time in the case of unhindered return than in the case of advancement under pressing conditions, there is at the same time also a generally desired "excess", in order to be certain of having achieved the interruption or the release of the pressing jaws before the position (the release position of the pressing jaws) that is required as a minimum to allow the next pressing to be carried out.

In FIG. 2, the pressing state of the unit according to FIG. 1 is presented.

In FIG. 3, the unit according to FIG. 1 is represented in the intermediate position then assumed in the case of return on the basis of the procedure described.

Figure 4:
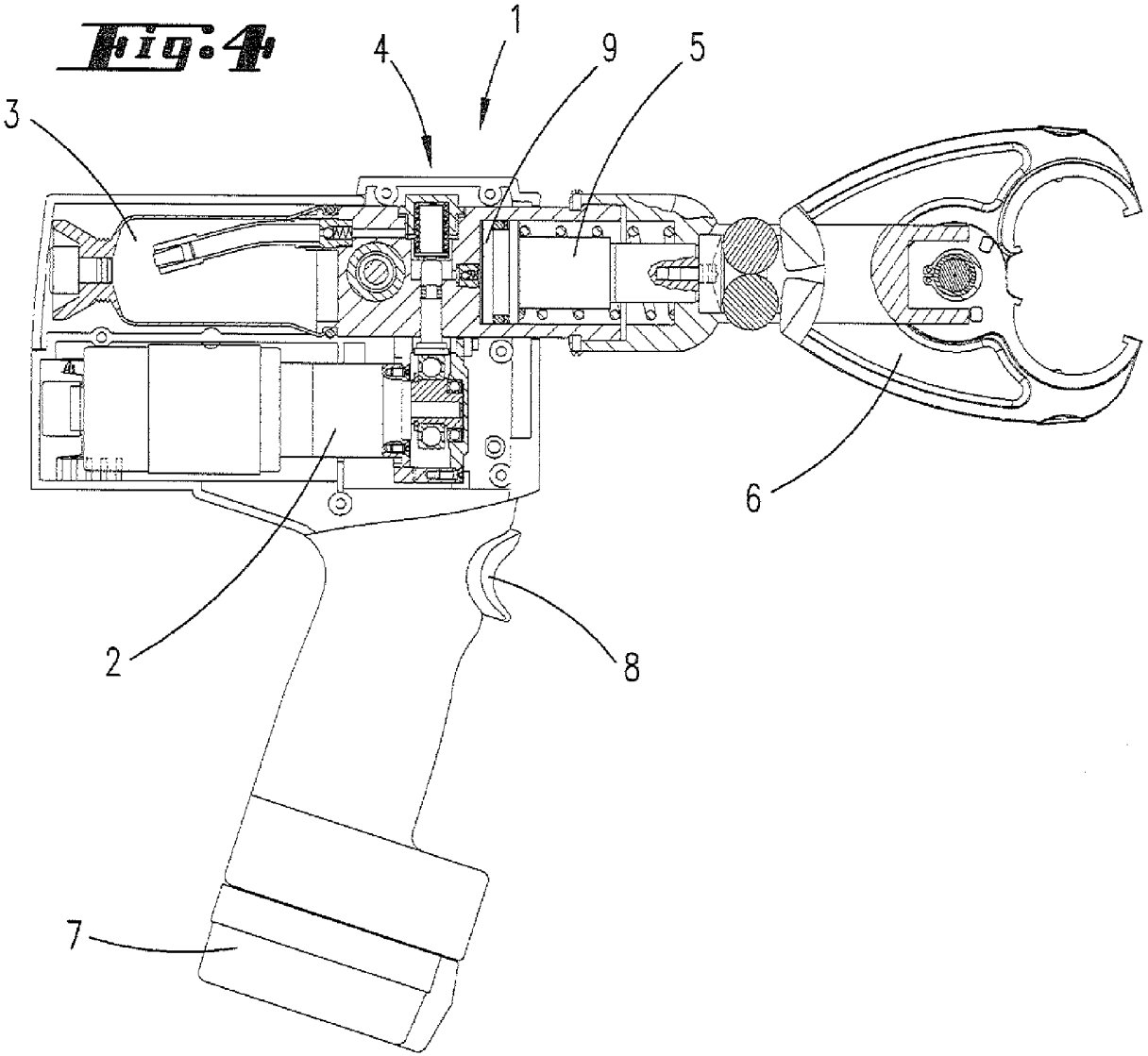
FIG. 4 shows a representation according to FIG. 1, but in the case of a configuration with two pressing jaws.

In FIG. 4, a unit with two pressing jaws is alternatively represented.

Figures 5, 12:
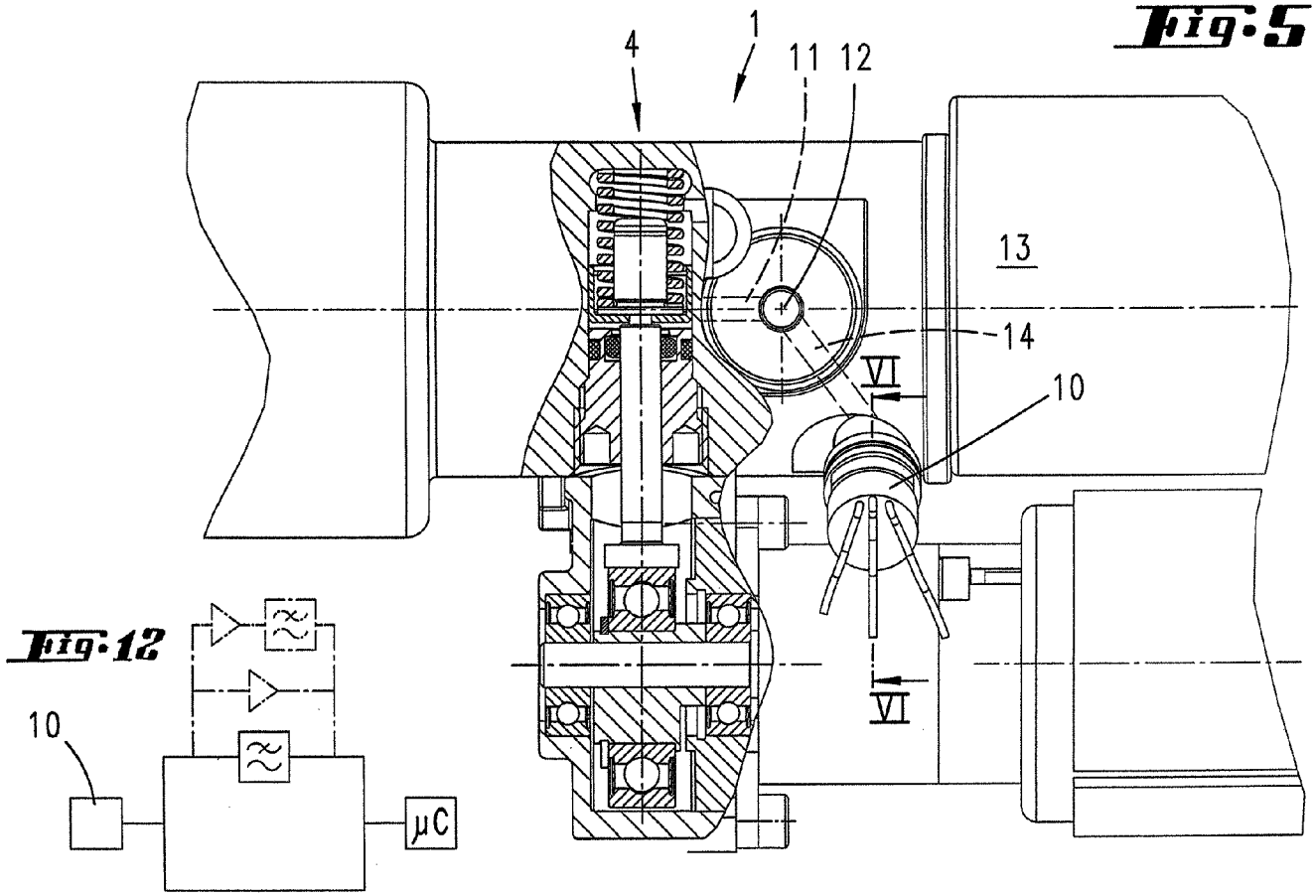
FIG. 5 shows a further sectional representation of a corresponding pressing unit in the region of the pump with a pressure sensor located there.
FIG. 12 shows a circuit used for the present invention.
Figure 6:
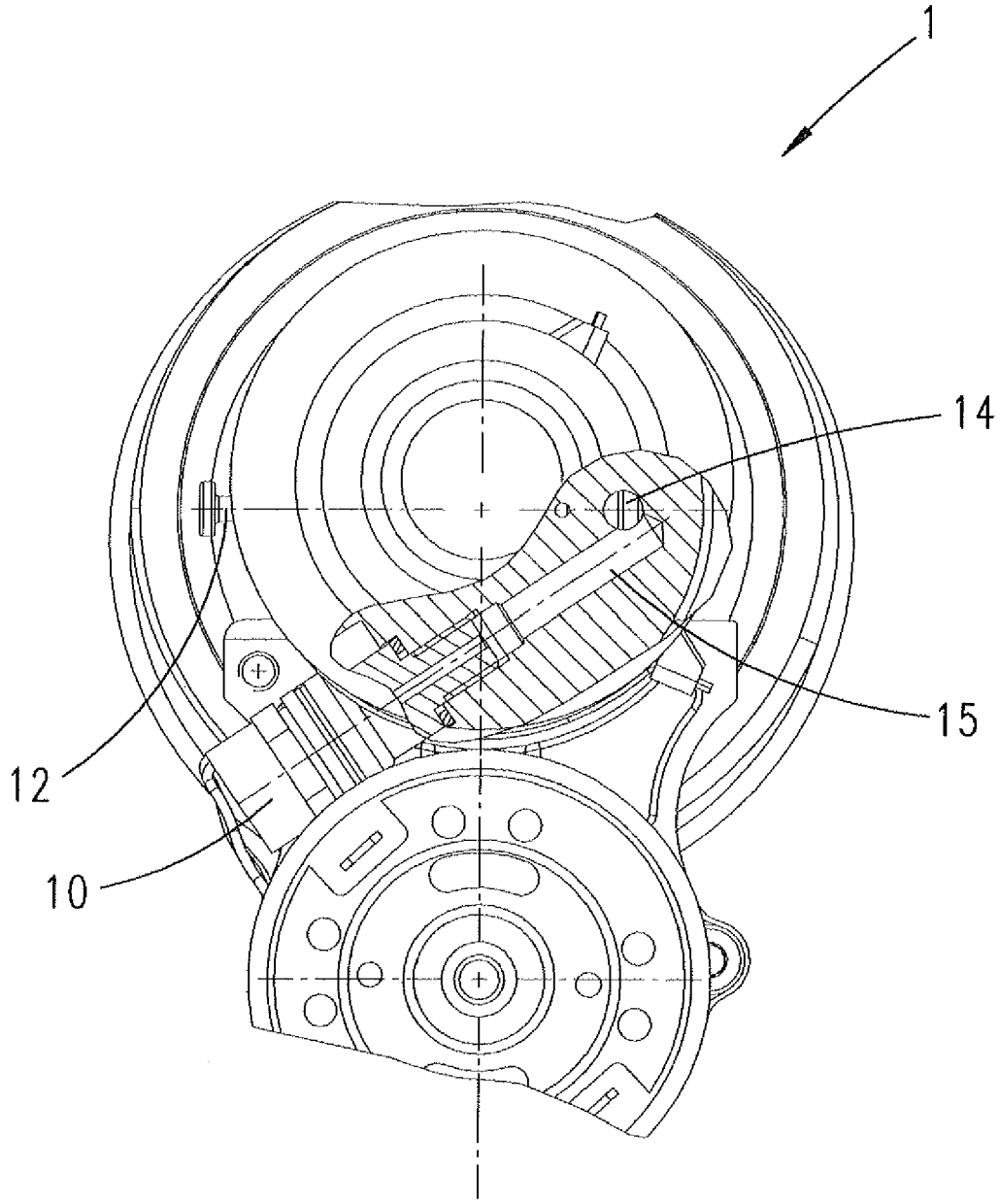
FIG. 6 shows a section through the subject matter according to FIG. 5, taken in section along the line VI-VI.

With reference to FIG. 5, a pressing unit in which a pressure sensor 10 is located is represented in a partially schematic view. As is evident in conjunction with FIG. 6, the pressure sensor is disposed such that it is associated with the return channel 11 of the hydraulic medium, by which return channel the hydraulic medium flows to the return valve 12 and from there, when the return valve is open, into the storage region 13. Provided from the return channel 11, on the other side of the branch extending to the return valve 12 as seen in the direction of return flow, is a side channel 14, which communicates with a receiving channel 15 of the pressure sensor 10, see FIG. 6. The pressure sensor is therefore disposed such that it is circumferentially offset in relation to the return valve 12 and/or the return channel 11.

Figure 7:
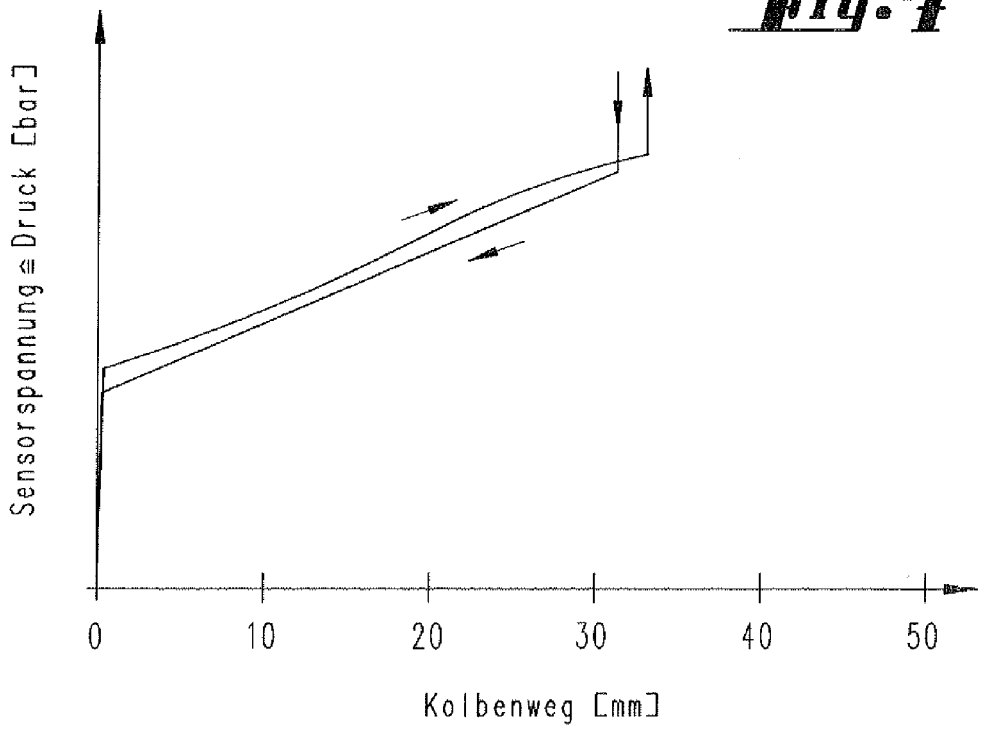
FIG. 7 shows a schematic representation of the pressure profile in the case of a pressing cycle in the region up to workpiece contact, plotted against the travel.

With reference to FIG. 7, the pressure measured by a pressure sensor over the piston travel during a pressing operation is qualitatively represented. This already corresponds to a conversion, since the actual pressure detection preferably generally takes place only over time. In principle, however, it is also possible for example to provide an additional travel sensor.

The curve is drawn here only up until the event that there is first significant workpiece contact, and consequently an increase in pressure. Accordingly, the pressure scale is also set out for very low pressures, for instance up to 10 bar, in the illustration. The pressure is preferably measured at regular time intervals, in the case of the embodiment, in intervals of five milliseconds.

It is important that, in the range of low pressures or initial piston travel, up until a first significant increase in pressure occurs as a result of workpiece contact, a linear profile is obtained, which has a hysteresis-like lag with respect to advancement and return. This pressure profile is explained by the fact that the return spring acting on the piston exerts a higher force with increasing compression. This explains the approximately linear rise in the pressure curve, as long as there is no first significant workpiece contact. The fact that furthermore the friction of the piston in the cylinder plays a role, but that this frictional force is opposed, depending on the direction of movement of the piston, means that the curves for the advancement and return are different. The pressure difference lies in the range from 0.5 to 1 bar.

On the basis of this relationship according to FIG. 7, when there is no workpiece contact, it is possible to deduce or calculate-back the position of the piston from the pressure measured. This can be used for instance for establishing, by comparison of the measured values, that piston position which still corresponds to the linear relationship before there is then a significant increase in pressure on account of workpiece contact. A piston position thus established can then be used subsequently as an intermediate position or holding position, from which the next pressing operation can then be started.

At the beginning of the movement of the pressing piston 5, a sudden increase in pressure takes place from zero to, for example, 4 or 5 bar. This sudden increase in pressure is attributable to the biasing of the return spring that is preferably provided.

Figure 8:
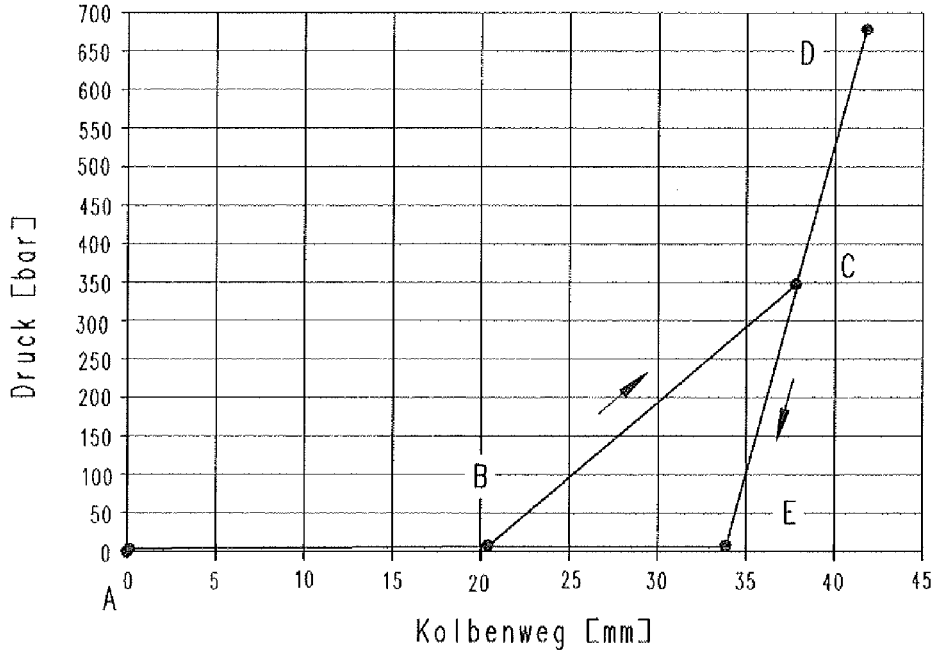
FIG. 8 shows a schematic representation of the pressure profile over a pressing cycle, plotted against the travel.
Figure 4:
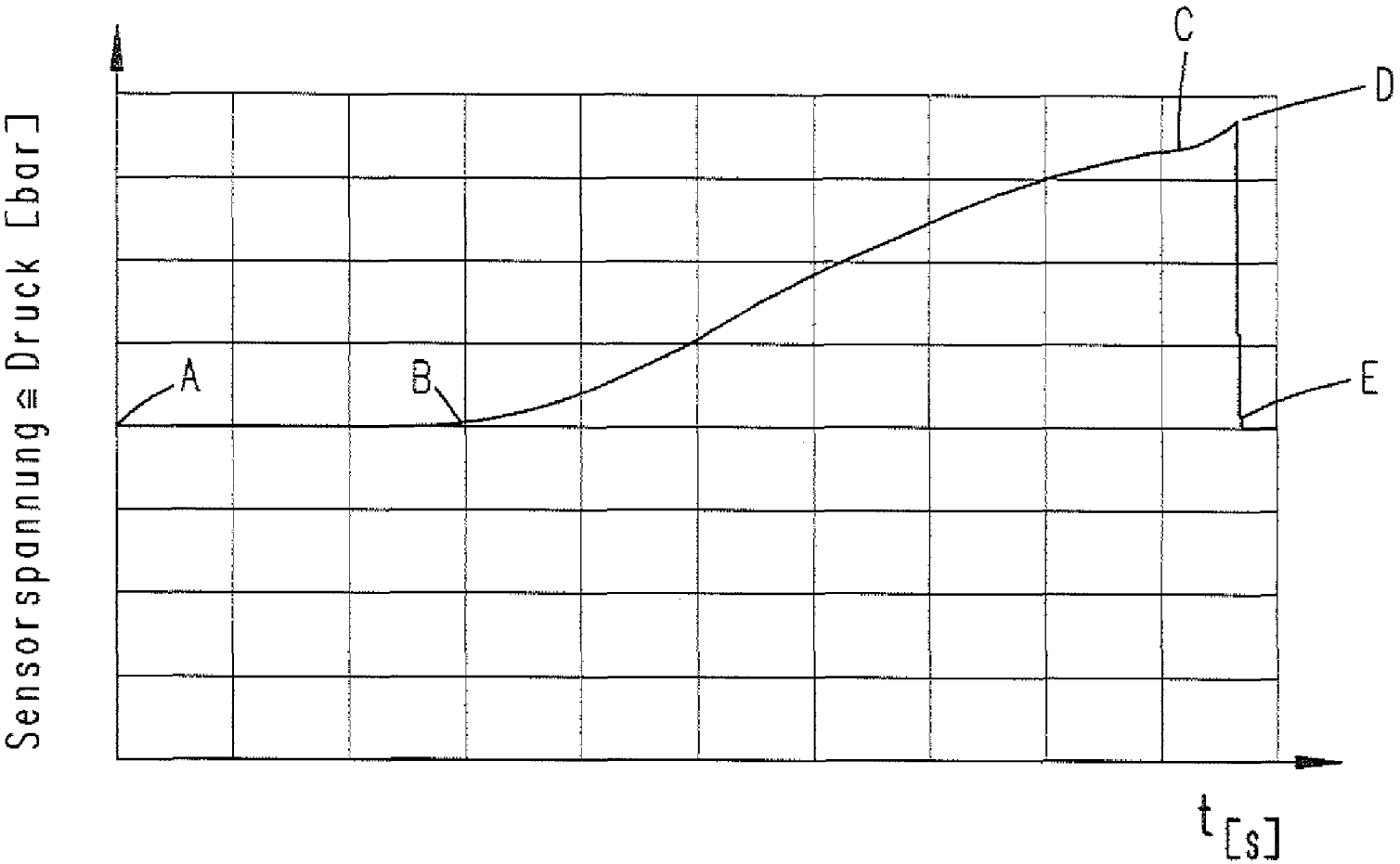

With reference to FIG. 8, the qualitative pressure profile in the case of a completed pressing is represented in an illustration that is fundamentally the same (pressure against travel) as in FIG. 7.

The pressing operation begins at the point A, here with the pressing piston assumed to have returned completely. Initially, the slight rise in pressure takes place up to the point B, which represents the workpiece contact and the beginning of a significant increase in the pressing pressure. The pressing proceeds up until the point C is reached, specifically in a way corresponding to a first pressure gradient. After the point C is reached, the pressing jaws lie on one another, but the triggering pressure for the end of the pressing operation or opening of the return valve has not yet been reached. There is then an increase in the pressure gradient up until the point D is reached.

At the point D, the return valve opens, or the pressing is ended and the pressure falls again until the point E, whereupon the return of the piston occurs, in the given case up until the point A. The increase in the pressure gradient between the points C and D is attributable to the fact that the pressing then works against—virtually only—the rigidity of the tool head itself, that is in fact with the pressing tools brought together. This is much greater than the rigidity of the workpiece to be pressed (gradient between B and C).

This difference in the pressure gradients, at least once first workpiece contact has taken place, which can also be established, as explained further above, on the basis for instance of the pressure sensor, but also on the basis of the motor current, can also be used for the further evaluation.

To be specific for the evaluation as to whether complete pressing has really been obtained, as a result of the fact that the pressure gradient between C and D, which at the same time also represents a tool constant in practice, is reached, it is implicitly the case that the pressing jaws lie against one another, the pressing operation therefore having taken place. Incomplete pressing may then also be used, for example, for triggering a signal, for example an acoustic signal. The signal must then be cancelled, again for example by specific actuation. Furthermore, a light-emitting diode may be provided in the pressing unit as an indicating means, for instance for the "pressing in progress" state.

In FIG. 9, the pressure profile (or a current measured at the pressure sensor) over time is plotted for the purposes of clarification. It is in respect of typical profile for a real pressing operation. Here, too, it is possible in principle to differentiate between the points described above, A, B, C, D and E.

All features disclosed are (in themselves) pertinent to the invention. The disclosure content of the associated/accompanying priority documents (copy of the prior patent application) is also hereby incorporated in full in the disclosure of the application, including for the purpose of incorporating features of these documents in claims of the present application.

The invention claimed is:

1. A method of operating a motor-actuated handheld pressing unit comprising the steps of:

actuating a switch, to initiate a first pressing operation whereby one or more pressing jaws are moved from a starting position to a closed pressing position;

automatically releasing said one or more pressing jaws when a prescribed pressing force has been reached or a prescribed amount of time has elapsed;

interrupting said automatic release to stop said one or more pressing jaws in an intermediate position which is between said closed pressing position and said starting position;

detecting and storing a measurement of travel and/or time and/or pressure which is associated with the intermediate position, said measurement being usable to interrupt said automatic release during subsequent pressing operations; and commencing a second pressing operation from said intermediate position whereby said one or more pressing jaws are moved from said intermediate position to said closed pressing position.

2. A method of operating a motor-actuated handheld pressing unit comprising the steps of:

actuating a switch to initiate a pressing operation whereby one or more pressing jaws are moved from a starting position to a closed pressing position;

automatically releasing said one or more pressing jaws by using a pressing piston when a prescribed pressing force has been reached or a prescribed amount of time has elapsed, the pressing piston being actuated hydraulically by a hydraulic medium; and checking the reaching of the prescribed pressing force by using a pressure sensor to detect the pressure of the hydraulic medium.

3. The method according to claim 1 wherein contact with a workpiece is determined and an associated measurement of travel, time or pressure is recorded.

4. The method according to claim 3, wherein said one or more pressing jaws are moved from said starting position to said closed pressing position by use of a motor; and the contact with the workpiece is determined by evaluating current within the motor.

5. The method according claim 1, wherein a time is measured from contact with a workpiece to completion of the first pressing operation, and the release of the one or more pressing jaws is interrupted after the elapse of a travel distance that corresponds to the time measured.

6. The method according claim 1, further including the step of automatically releasing said one or more pressing jaws during said second pressing operation when said prescribed pressing force has been reached or said prescribed amount of time has elapsed, said one or more pressing jaws are moved from said closed pressing position to the intermediate position.

7. The method according to claim 1, wherein the measurement of travel and/or time is recorded as a result of a freely selected interruption.

8. The method according to claim 1, wherein the measurement of travel and/or time is recorded as a result of a change in the actuating cycle which results from said switch being repeatedly briefly actuated, and when said intermediate position is reached, said switch is continuously depressed until a pressing operation has been completed.

9. The method according to claim 2, wherein the checking of the reaching of the prescribed pressing force is carried out by comparison between a prescribed minimum pressure value and a pressure value actually achieved.

10. The method according to claim 3, further including the step of monitoring pressure gradients using pressure detection during said first pressing operation.

11. The method according to claim 3, further including the step of evaluating a transition to a steeper rise in pressure, which is detected after contact with said workpiece.

12. The method according to claim 10, further including providing a return valve, and checking an automatic opening of the return valve by the pressure detection.

13. The method according to claim 12, wherein stopping of said one or more pressing jaws maintains a desired pressure is performed by prescribing a threshold pressure value that lies below a maximum pressure value to be achieved for the ending of one of said pressing operations.

14. The method according to claim 1, wherein said one or more pressing jaws are moved from said starting position to said closed pressing position by use of a pressing piston.

15. The method according to claim 2, wherein a time is measured from contact with a workpiece to completion of the pressing operation, and the release of the one or more pressing jaws is interrupted after the elapse of a travel distance that corresponds to the time measured.

16. The method according to claim 2, wherein the pressing operation is monitored with regard to different pressure gradients by pressure detection.

* * * * *